US010016977B2

(12) United States Patent
Stefani et al.

(10) Patent No.: US 10,016,977 B2
(45) Date of Patent: Jul. 10, 2018

(54) DEVICE FOR THE INKJET PRINTING OF FLUIDS, IN PARTICULAR GLAZES, ONTO TILES

(71) Applicant: SYSTEM S.P.A., Fiorano Modenese (Modena) (IT)

(72) Inventors: Franco Stefani, Sassuolo (IT); Mohamed Ouassif, Varana Serramazzoni (IT)

(73) Assignee: SYSTEM S.P.A., Fiorano Modenese (IT)

( * ) Notice: Subject to any disclaimer, the term of this patent is extended or adjusted under 35 U.S.C. 154(b) by 0 days.

(21) Appl. No.: 15/307,885

(22) PCT Filed: May 19, 2015

(86) PCT No.: PCT/IB2015/053683

§ 371 (c)(1),
(2) Date: Oct. 31, 2016

(87) PCT Pub. No.: WO2015/186014

PCT Pub. Date: Dec. 10, 2015

(65) Prior Publication Data

US 2017/0087837 A1 Mar. 30, 2017

(30) Foreign Application Priority Data

Jun. 4, 2014 (IT) ..... MO2014A0164

(51) Int. Cl.
*B41J 2/14* (2006.01)
*B41J 2/04* (2006.01)

(52) U.S. Cl.
CPC ..... *B41J 2/1433* (2013.01); *B41J 2002/041* (2013.01)

(58) Field of Classification Search
CPC .. B41J 2/1433; B41J 2002/041; B05B 1/3053
(Continued)

(56) References Cited

U.S. PATENT DOCUMENTS 3,429,552 A * 2/1969 Erickson ..... F16K 31/0658 251/129.17
5,356,034 A 10/1994 Schlumberger
(Continued)

FOREIGN PATENT DOCUMENTS

EP 1 211 075 A1 6/2002
JP 2011 201225 A 10/2011

*Primary Examiner* — Huan Tran
*Assistant Examiner* — Alexander D Shenderov
(74) *Attorney, Agent, or Firm* — Pearne & Gordon LLP

(57) ABSTRACT

A device (1) for inkjet printing of fluids, particularly glazes, onto tiles (P) comprises a body (2) comprising a feed channel (3) of a printing fluid, which feed channel (3) is closed by a base (4). The base comprises at least one outlet nozzle (5) associated with a valve (7) comprising electromagnetic actuating means (8). A shutter (11) of the valve (7) comprises at least one sensitive element (12) made of a material suitable for interacting with the magnetic field generated by the electromagnetic actuating means (8) for moving the shutter. A membrane (13) is arranged within the body (2) and delimits the feed channel (3). The membrane (13) is interposed between the feed channel (3) and the electromagnetic actuating means (8). The shutter (11) is solidly constraint with the membrane (13).

13 Claims, 4 Drawing Sheets

(58) Field of Classification Search
USPC ..... 347/53
See application file for complete search history.

(56) References Cited

U.S. PATENT DOCUMENTS

| | | | | |
|---|---|---|---|---|
| 5,447,288 | A * | 9/1995 | Keuerleber | H01F 7/1638<br>251/129.16 |
| 5,907,339 | A * | 5/1999 | Evans | B41J 2/04<br>347/20 |
| 6,517,045 | B1 * | 2/2003 | Northedge | F16K 31/082<br>251/129.16 |
| 2002/0029814 | A1 * | 3/2002 | Unger | B01L 3/502707<br>137/824 |
| 2002/0071003 | A1 | 6/2002 | Kimura | |
| 2003/0197143 | A1 * | 10/2003 | Kai | F02M 25/0836<br>251/129.17 |
| 2005/0056713 | A1 | 3/2005 | Tisone et al. | |

* cited by examiner

Fig.1
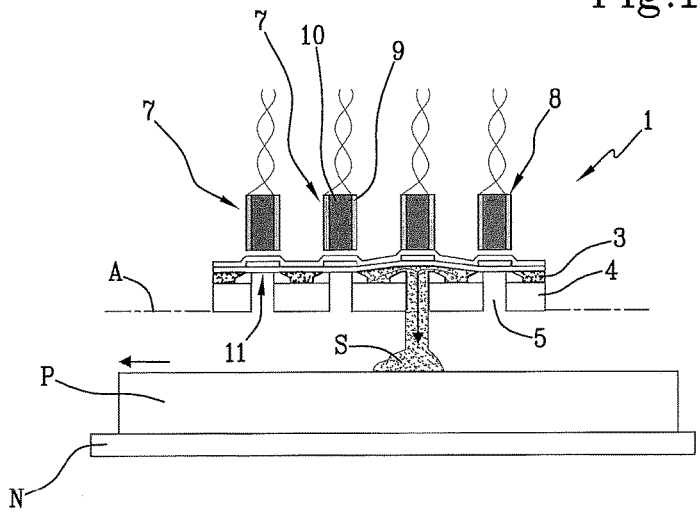
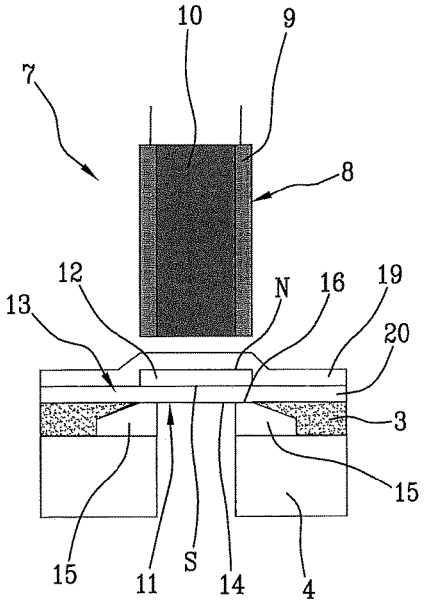
Fig.2
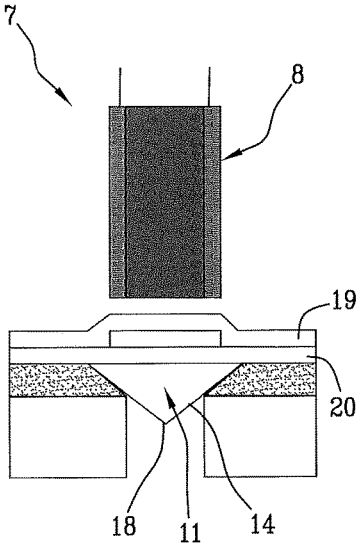
Fig.3

Fig.4
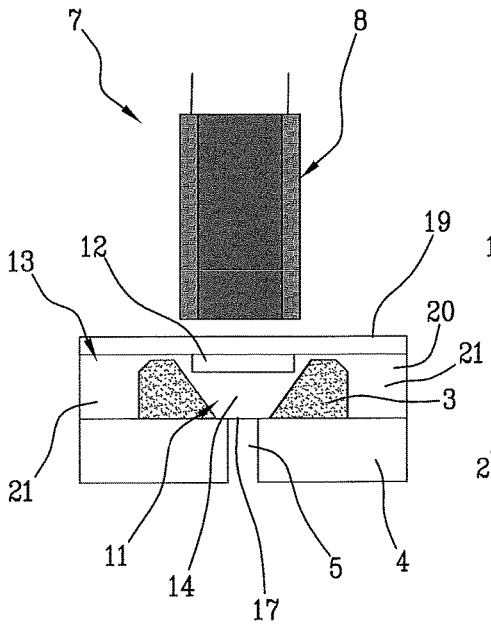
Fig.5
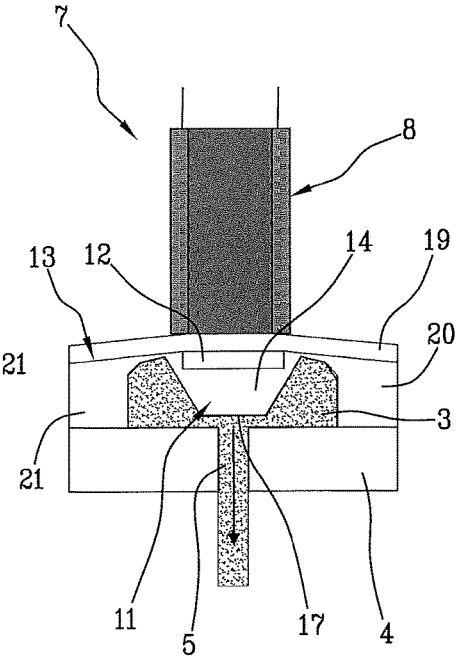
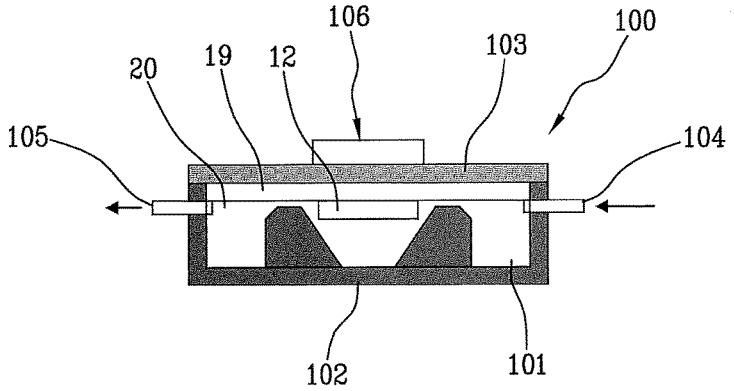
Fig.6

DEVICE FOR THE INKJET PRINTING OF FLUIDS, IN PARTICULAR GLAZES, ONTO TILES

The invention relates to a device for the inkjet printing of fluids, in particular glazes, onto tiles.

Such devices define a printhead via which a glaze is delivered through a series of outlet nozzles for decorating a tile arranged along a conveyor belt. To each outlet nozzle, a generally electromagnetic actuating valve is associated for opening the outlet nozzle according to the pattern which is to be reproduced on the tile. Closing of the outlet nozzle is generally ensured by elastic means. An example of an electromagnetic actuating valve is described in US2005/0056713, wherein an electromagnet provided with a ferromagnetic core, acts on a shutter of the outlet nozzle so as to shift the latter from the closed position to the open position thereof. The return movement, namely that from the open position to the closed position with maintained closing of the outlet nozzle, is ensured by a helical spring.

In known devices, the air-gaps provided for electromagnetic actuation are crossed by the glazes, which glazes are in contact with the elastic means, as well as the coil of the electromagnet and the ferromagnetic core.

Since the glazes contain impurities, such contact can lead to fouling or clogging, thereby resulting in limited operational capacities of the valve and hence in a consequent need for frequent maintenance.

Furthermore, the known devices are rather complex.

In this context, the technical task at the base of the present invention is to provide a device for inkjet printing of fluids, in particular glazes, onto tiles which overcomes the drawbacks of the known art mentioned above.

In particular, it is an object of the invention herein to provide a device for inkjet printing of fluids, in particular glazes, onto tiles, owing to which the glaze flow exiting from the nozzle is caused to become reliable and constant.

A possible further object of the invention herein, is to provide a simple device by limiting the number of components required for operation thereof.

The technical task mentioned and the aims specified are substantially achieved by a device for inkjet printing of fluids, in particular glazes, onto tiles, comprising the technical features described in one or more of the appended claims. The technical task mentioned and the aims specified are substantially attained by a mould and method for producing a membrane of a device for inkjet printing of fluids, in particular glazes, onto tiles, comprising the technical features as described in one or more of the appended claims.

The dependent claims correspond to different embodiments of the invention.

According to a possible aspect, the invention relates to a device for inkjet printing of fluids, in particular glazes, onto tiles, including a body comprising a feed channel of a printing fluid, which feed channel is closed by a base comprising at least one outlet nozzle of the printing fluid. A valve comprises electromagnetic actuating means suitable for generating a magnetic field and a shutter, comprising at least one sensitive element made of a material suitable for interacting with the magnetic field for moving aforementioned shutter. The valve is operatively associated to the outlet nozzle so as to determine an open condition corresponding to an open position of the shutter, wherein the outlet nozzle is arranged in communication with the feed channel, and a closed condition corresponding to a closed position of the shutter in which the communication between the outlet nozzle and the feed channel is closed by said shutter. A membrane is disposed within the body and delimits the feed channel. The membrane is interposed between the feed channel and the electromagnetic actuating means. The shutter is solidly constraint to the membrane.

In accordance with a second aspect, the present invention relates to a mould for realizing a membrane of a device for inkjet printing of fluids, in particular glazes, onto tiles. The mould comprises a cavity which is counter-shaped with respect to the membrane, as well as magnetic retaining means arranged outside said cavity and adapted to retain a sensitive element of the membrane in a given position inside aforesaid cavity.

According to a further aspect, the invention herein relates to a method for realizing a membrane of a device for inkjet printing of fluids, in particular glazes, onto tiles. The method comprises predisposing the mould, retaining the sensitive element in a determined position inside the cavity by means of the magnetic retaining means, injecting a material into the cavity so as to form at least one layer of the membrane thus surrounding the sensitive element at least partially.

In one or more of the above aspects, the present invention comprises one or more of the following features.

The shutter is preferably defined by a closing portion of the membrane which opens into the outlet nozzle.

The closing portion preferably is wedge-shaped with a lower base or vertex arranged towards the outlet nozzle.

Preferably, a closing portion is suitable for being inserted at least partially into the outlet nozzle in the closed position of the shutter.

Preferably, the sensitive element is disposed within the membrane.

Preferably, the membrane comprises at least two layers and the sensitive element is arranged between the two layers.

Preferably, the membrane comprises support walls projecting from opposite sides of the shutter, which sides laterally delimit the feed channel against the base.

Preferably the membrane is at least partially made of silicone material. The sensitive element being preferably a permanent magnet. The electromagnetic actuating means are configured for generating a first attractive magnetic field and a second repulsive magnetic field of the sensitive element for moving the shutter between the closed position and the open position in both directions.

Preferably the sensitive element is made of ferromagnetic material so as to be attracted by the magnetic field generated by the electromagnetic actuating means.

The device preferably comprises a plurality of outlet nozzles arranged in line, each of which is associated with a corresponding valve. The membrane comprises a stiffening portion disposed between two consecutive shutters.

Preferably it is provided predisposing a first layer of the membrane within the cavity of the mould, retaining the sensitive element resting against the first layer within the cavity by means of the retaining magnetic means, injecting a material into the cavity so as to obtain at least a second layer of the membrane thus incorporating the sensitive element.

Further characteristics and advantages of the present invention will become more apparent from the indicative, and therefore non-limiting, description of a preferred but not exclusive embodiment of a device for inkjet printing of fluids, in particular glazes, onto tiles, with reference to the appended drawings wherein:

FIG. 1 is a schematic view in section of a device for inkjet printing of fluids, in particular glazes, onto tiles;

FIG. 2 is a schematic view in section of a detail of the device of FIG. 1;

FIGS. 3 and 4 are schematic views in section of possible alternatives to the embodiment of FIG. 2;

FIG. 5 shows the device of FIG. 4 in a different operating condition;

FIG. 6 is a schematic view in section of a mould for realizing a membrane of the device of FIG. 4 or 5;

Figure 7:
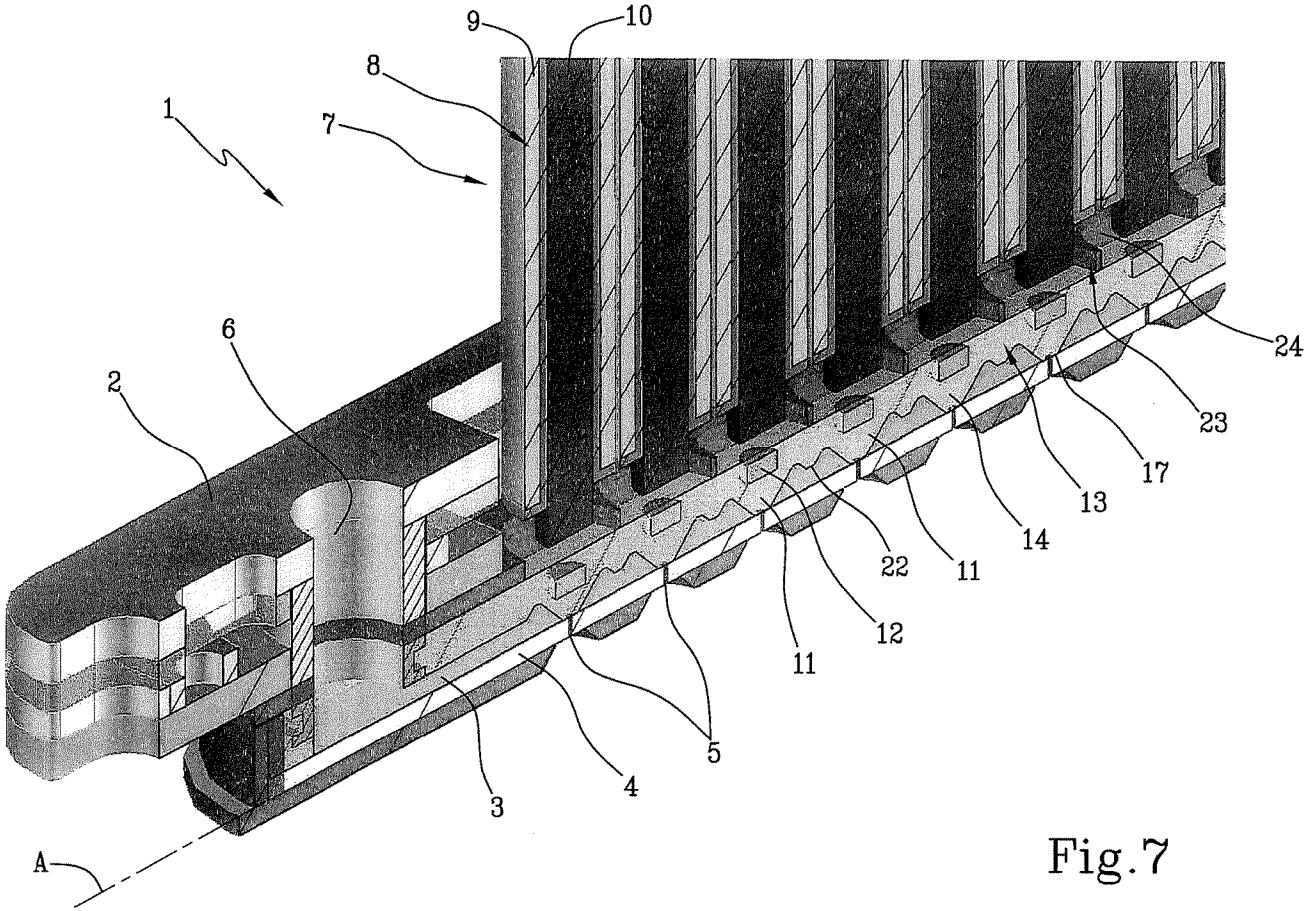
FIG. 7 is a schematic perspective view in section of a device for inkjet printing of fluids, in particular glazes, onto tiles.
Figure 8:
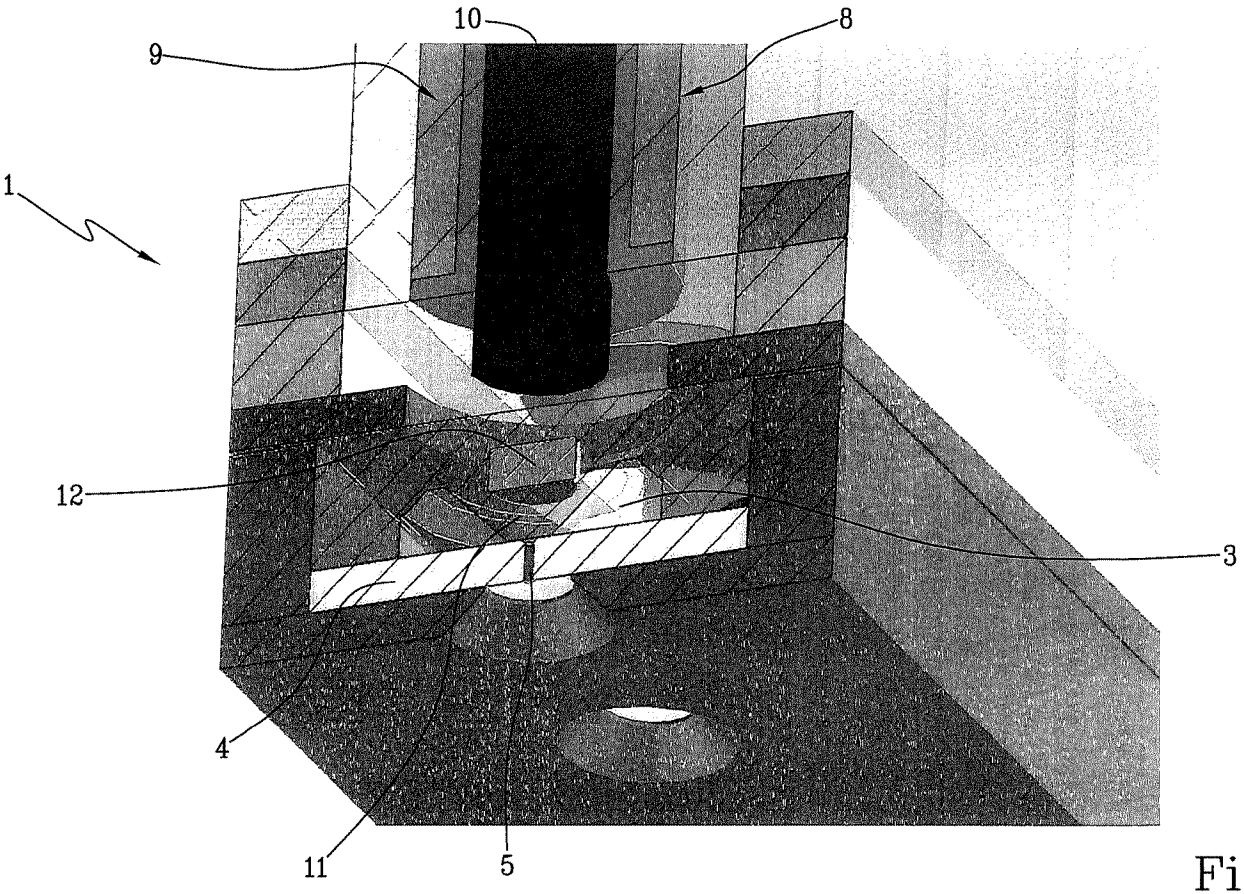
FIG. 8 is a schematic view of a detail of the device of FIG. 7 in a perspective sectioned according to a plane perpendicular to the section plane of FIG. 7.

With reference to the attached figures, the numeral 1 indicates a device for inkjet printing of fluids, in particular glazes, onto tiles P. FIG. 1 illustrates the tile P transported on a conveyor belt N, so as to end into the device 1 thus receiving a determined quantity of fluid, in particular glaze S, according to the drawings or pre-established pictures.

The device 1 comprises a body 2 defining a printhead. Inside the body, a feed channel 3 of the printing fluid is realized, which feed channel 3 is closed by a base 4, comprising at least an outlet nozzle 5 of the printing fluid.

In the example illustrated in FIG. 7 there is provided a plurality of outlet nozzles 5 arranged in line along a line of extension A and fed by the same feed channel 3. There may be provided two or more nozzles aligned in a direction perpendicular to the line of extension thereby forming, by way of example, a nozzles array.

The body 2 also comprises an inlet channel 6 placed in communication with the feed channel 3. The inlet channel 6 is adapted to be connected to a tank of pressurized fluid, which is not shown.

To each outlet nozzle 5, a valve 7 is operatively associated for determining an open condition thereof, wherein the outlet nozzle 5 is arranged in communication with the feed channel 3 and a closed condition, wherein the communication between the outlet nozzle 5 and the feed channel 3 is prevented.

The valve 7 comprises electromagnetic actuating means 8 suitable for generating a magnetic field. The electromagnetic actuating means 8 particularly comprises an electromagnet comprising, by way of example, a winding 9 and a ferromagnetic core 10.

The valve 7 also comprises a shutter 11 movable between an open position corresponding to the condition wherein the outlet nozzle 5 opens, and a closed position corresponding to the condition in which the outlet nozzle 5 is closed.

The shutter 11 comprises at least one sensitive element 12 made of a material which is suitable for interacting with the magnetic field for moving said shutter 11. In the example illustrated in the figures, the sensitive element 12 is a permanent magnet of which the poles S and N were indicated. Preferably the electromagnetic actuating means 8 are configured for generating a first attractive magnetic field and a second repulsive magnetic field of the sensitive element 12 which is realized in the form of a permanent magnet, so as to move the shutter 11 between the closed position and the open position in both directions.

A membrane 13 is disposed within the body 2 and delimits the feed channel 3. Furthermore, the membrane 13 is interposed between the feed channel 3 and the electromagnetic actuating means 8.

Upon opening and/or closing of the outlet nozzle 5, the shutter 11 is solidly constraint with the membrane 13.

The shutter 11 is particularly defined by a closing portion 14 of the membrane 13 facing the outlet nozzle 5.

According to the embodiment illustrated in FIG. 1 or 2, the closing portion 14 of the membrane 13 is a planar portion adapted to come into contact with the base 4. Preferably, the base 4 comprises a boundary ring 15 facing inwardly the feed channel 3 relative to each outlet nozzle 5, thereby defining a contact surface 16 suitable for coming into contact with the closing portion 14 of the membrane 13.

According to the embodiment illustrated in FIG. 4 or 5, the closing portion 14 is wedge-shaped with the lower base 17 thereof arranged towards the outlet nozzle 5.

According to the embodiment illustrated in FIG. 3, the closing portion 14 is wedge-shaped with the vertex 18 thereof disposed toward the outlet nozzle 5. In particular, the closing portion 14 is suitable for being inserted, at least partially, into the outlet nozzle 5 when the shutter 11 is in its closed position.

Preferably the sensitive element 12 is arranged within the membrane 13. The membrane 13 particularly comprises at least two layers (a first layer 19 and a second layer 20) and the sensitive element 12 is disposed between the two layers.

According to a possible embodiment, illustrated by way of example in FIGS. 4 and 5, the membrane 13 comprises support walls 21 projecting from opposite sides of the shutter 11, which support walls 21 laterally delimit the feed channel 3 against the base 4. In particular, where there is provided a plurality of outlet nozzles 5, the support walls 21 are arranged parallel to the line of extension A, along which the outlet nozzles 5 are arranged.

In the case in which there is provided a plurality of outlet nozzles 5, the membrane 13 may comprise a stiffening portion 22 (FIG. 7) arranged between two consecutive shutters 11. The thickness of the stiffening portion 22 is greater than the thickness of the membrane 13 and less than the thickness of the shutter 11. In other words, the stiffening portion 22 extends into the feed channel without coming into contact with the base 4.

According to a possible embodiment, the body 2 comprises a containment plate 23 arranged between the membrane 13 and the electromagnetic actuating means 8, said containment plate 23 comprising a through opening 24 for each outlet nozzle 5, which through opening 24 defines a portion of the membrane around the shutter 11. In particular, the through opening 24 extends up to the stiffening portion 22, if applicable.

Preferably, the membrane 13 is at least partially made of silicone material. With reference to the embodiment illustrated in the figures and comprising a permanent magnet in the form of a sensitive element, the device 1 according to the invention herein, provides in use, constant activation of the electromagnetic actuating means. In a first step, the electromagnetic actuating means are configured for generating a first attractive magnetic field of the sensitive element, so that the shutter is moved from the closed position to the open position thereof (see for example FIG. 5). In a second step, the electromagnetic actuating means are instead configured for causing a second repulsive magnetic field of the sensitive element, so that the shutter is moved from the open position to the closed position thereof and kept closing the outlet nozzle 5 (see for example FIGS. 2-4).

Referring to FIG. 6, in order for the membrane 13 to be realized, it can be provided a mould 100 comprising a cavity 101 which is counter-shaped relative to the membrane shape. With reference to FIG. 6, a first portion 102 of the mould is closed by a second portion 103, so as to define the cavity 101. An inlet 104 flows into the cavity 101 for access of the membrane forming material, e.g. pressure silicone. An outlet 105 flows outside the cavity 101 for the exit of air and silicone in excess.

By 106 there are indicated magnetic retaining means disposed outside the cavity 101 and suitable for retaining the sensitive element 12, particularly in the form of a permanent magnet in a determined position inside said cavity.

The membrane 13 can be realized by means of the mould 100 described hereinabove, i.e. by predisposing said mould 100 and by retaining the sensitive element 12 in a given position inside the cavity through the retaining means 106. The magnetic material suitable for realizing the membrane, is injected into the cavity 101 thereby forming at least a layer of said membrane, so that the sensitive element 12 is at least partially surrounded.

Preferably, in the case of two layers 19, 20, there is provided predisposing a first layer 19 of the membrane within the cavity 101, retaining the sensitive element 12 resting against the first layer 19 within the cavity 101 via the magnetic retaining means 106, injecting the material suitable for realizing the second layer 20 within the cavity 101, so as to incorporate the sensitive element 12.

Alternatively, a co-moulding can be provided wherein the second layer 20 is initially realized, and a housing for the sensitive element is therein defined by means of a mould insert. Subsequently the mould is opened for insertion of the sensitive element and then closed again, thus leaving a cavity corresponding to the first layer, if provided, into which the corresponding material is injected.

The invention claimed is:

1. A device (1) for the inkjet printing of fluids, in particular glazes, onto tiles (P) comprising:

a body (2) comprising a feed channel (3) of a printing fluid, which feed channel (3) is closed by a base (4) comprising at least one outlet nozzle (5) of said printing fluid (S), a valve (7) comprising electromagnetic actuating means (8) adapted to generate a magnetic field and a shutter (11) comprising at least one sensitive element (12) made of a material suitable for interacting with said magnetic field for the movement of the shutter itself, said valve (7) being configured such that when said electromagnetic actuating means (8) is energized, the magnetic field is generated and acts on the sensitive element (12) which causes the valve (7) to determine an open or closed condition; said valve (7) being operatively associated with said outlet nozzle (5) to determine said open condition corresponding to an open position of said shutter (11) wherein said outlet nozzle (5) is arranged in communication with said feed channel (3) and said closed condition corresponding to a closed position of said shutter (11), wherein said shutter (11) closes communication between said outlet nozzle (5) and said feed channel (3), a membrane (13) arranged in said body (2) and delimiting said feed channel (3), wherein said membrane (13) is interposed between said feed channel (3) and said electromagnetic actuating means (8) and wherein said shutter (11) is solidly constrained with said membrane (13), wherein said sensitive element (12) is arranged within said membrane (13) so that a first portion of the membrane (13) is located between the sensitive element (12) and the electromagnetic actuating means (8) such that the whole sensitive element (12) is more distant from the electromagnetic actuating means (8) than said first portion; wherein the membrane (13) separates and isolates the sensitive element (12) from the electromagnetic actuating means (8) so that the membrane (13) causes or results in the sensitive element (12) being spaced apart from and non-contacting with the electromagnetic actuating means (8).

2. The device according to claim 1, wherein a closing portion (14) of said membrane (13) facing said outlet nozzle (5) defines at least a portion of said shutter (11).

3. The device according to claim 2, wherein said closing portion (14) is wedge-shaped with a lower base (17) or vertex (18) arranged towards said outlet nozzle (5).

4. The device according to claim 3, wherein said closing portion (14) is suitable to be inserted at least partially into said outlet nozzle (5) in the closed position of the shutter (11).

5. The device according to claim 1, wherein said membrane (13) comprises at least two layers (19, 20) and wherein said sensitive element (12) is arranged between said two layers (19, 20).

6. The device according to claim 1, wherein said membrane (13) comprises support walls (21) projecting from opposite sides of said shutter (11) laterally delimiting said feed channel (3) against said base (4).

7. The device according to claim 1 wherein said membrane (13) is at least partially made of silicone material.

8. The device according to claim 1, wherein said sensitive element (12) is a permanent magnet and wherein said electromagnetic actuating means (8) are configured to generate a first attractive magnetic field and a second repulsive magnetic field of said sensitive element (12) so as to move said shutter (11) between the closed position and the open position in both directions.

9. The device according to claim 1, wherein said sensitive element (12) is made of ferromagnetic material to be attracted by the magnetic field generated by said electromagnetic actuating means (8).

10. The device according to claim 1, comprising a plurality of outlet nozzles (5) arranged in line, each associated with a relative valve (7), wherein said membrane (13) comprises a stiffening portion (22) arranged between two consecutive shutters (11).

11. The device according to claim 1, wherein said outlet nozzle (5) has an inlet portion and an outlet portion, wherein said shutter (11), in the closed position, closes the inlet portion of the outlet nozzle (5) but leaves the outlet portion of the outlet nozzle (5) open.

12. The device according to claim 1, wherein the magnetic field must pass through the membrane (13) in order to act on the sensitive element (12).

13. The device according to claim 1, wherein, in use, the sensitive element (12) is caused to move by the magnetic field acting on the sensitive element (12).

* * * * *